US012098484B2

(12) United States Patent
Balakrishnan

(10) Patent No.: US 12,098,484 B2
(45) Date of Patent: Sep. 24, 2024

(54) WOVEN QUILT

(71) Applicant: Gopalarathinam Balakrishnan, Pearland, TX (US)

(72) Inventor: Gopalarathinam Balakrishnan, Pearland, TX (US)

( * ) Notice: Subject to any disclaimer, the term of this patent is extended or adjusted under 35 U.S.C. 154(b) by 0 days.

(21) Appl. No.: 17/662,917

(22) Filed: May 11, 2022

(65) Prior Publication Data

US 2023/0250564 A1 Aug. 10, 2023

(30) Foreign Application Priority Data

Feb. 10, 2022 (IN) ..... 202211007157

(51) Int. Cl.
*D03D 1/00* (2006.01)
*D03D 25/00* (2006.01)
*D03D 11/00* (2006.01)

(52) U.S. Cl.
CPC ..... *D03D 25/005* (2013.01); *D03D 1/0017* (2013.01)

(58) Field of Classification Search
CPC ..... D03D 25/005; D03D 1/0017
See application file for complete search history.

(56) References Cited

U.S. PATENT DOCUMENTS 4,736,535 A * 4/1988 Rucker ..... D05C 1/02 248/172
4,879,169 A * 11/1989 Zafiroglu ..... D04H 1/52 428/102
5,523,144 A * 6/1996 Dyer, Jr. ..... A47C 27/05 442/224
5,619,748 A * 4/1997 Nelson ..... F41H 5/0478 2/2.5
5,724,670 A * 3/1998 Price ..... F41H 5/0485 2/2.5
5,855,032 A * 1/1999 Field ..... A47G 9/0207 428/102
9,138,066 B1 * 9/2015 Goenka ..... A47C 27/002
2004/0172754 A1 * 9/2004 Brooks ..... A47C 27/002 5/737
2011/0099722 A1 * 5/2011 Moret ..... A47C 27/148 5/701
2013/0174344 A1 * 7/2013 Klancnik ..... A47C 27/15 428/221
2013/0174346 A1 * 7/2013 Klancnik ..... B32B 5/18 428/71
2013/0196109 A1 * 8/2013 Rock ..... B32B 5/024 28/165
2017/0055778 A1 * 3/2017 Hetland ..... A47K 3/001
2018/0279795 A1 * 10/2018 Murphy ..... A47C 27/002
2019/0191801 A1 * 6/2019 Hozumi ..... D03D 19/00
(Continued)

OTHER PUBLICATIONS https://www.fabriclink.com/dictionaries/textile.cfm#W; definition of 'weaving'; 1995 (Year: 1995).*

*Primary Examiner* — Robert H Muromoto, Jr.
(74) *Attorney, Agent, or Firm* — MacCord Mason PLLC

(57) ABSTRACT

The present disclosure relates to a textile fabric comprising a casing of three layers, the three layers comprising a top layer, a bottom layer, and an intermediate layer that is arranged between the top layer and bottom layer, wherein the top layer, the intermediate layer, and the bottom layers are bonded together through weaving, and forming a casing including a binding element.

20 Claims, 4 Drawing Sheets

Denier Texturised Filment Inserted Between Top And Bottom Layer

(56) References Cited

U.S. PATENT DOCUMENTS

| | | | | |
|---|---|---|---|---|
| 2019/0281909 | A1* | 9/2019 | Rock | A41D 27/28 |
| 2020/0113345 | A1* | 4/2020 | DeFranks | D06M 15/263 |
| 2021/0025092 | A1* | 1/2021 | Jackson | D05B 39/005 |
| 2022/0395116 | A1* | 12/2022 | Balakrishnan | A47G 9/0246 |

* cited by examiner

200

WOVEN QUILT

CROSS-REFERENCE TO RELATED APPLICATIONS

This application claims the benefit under 35 U.S.C. § 119(b) of Indian Patent Application No. 202211007157, filed on Feb. 10, 2022, which application is incorporated herein by reference in its entirety.

FIELD

The present disclosure relates, in general, to woven textile fabric, and more specifically, relates to a method for fabricating multi-pieced woven quilts, a system for a quilted bedding item and the like, and/or a quilted, woven textile fabric.

BACKGROUND

Quilting is a special art in the general field of sewing in which patterns are stitched through a plurality of layers of material over a two-dimensional area of the material. The multiple layers of material normally include at least three layers, where one layer may include a woven primary or facing sheet having a decorative finished quality. Another layer may include a usually woven backing sheet that may or may not be of a finished quality, and one or more internal layers of thick filler material, usually of randomly oriented fibers. The stitched patterns maintain the physical relationship of the layers of material to each other as well as provide ornamental qualities.

The process of quilting may employ a needle and thread to join two or more layers of material together to make a quilt. Typical quilting is done with three layers such as a top layer, middle layer, and bottom layer. The quilter's hand or sewing machine passes the needle and thread through all layers and then brings the needle back up. The process is repeated across the entire piece where quilting is desired. A straight or running stitch is commonly used, and these stitches can be purely functional, decorative, and elaborate.

The existing process of quilting suffers from limitations that include the breakage of stitches in the top layer during washing, resulting in the de-shaping of the product. The individual fiber may protrude through pores of fabric, causing discomfort to the user while sleeping.

Therefore, there is a need in the art to address the above-mentioned limitations and other disadvantages by providing safe, cost-efficient, and secure stitches of the quilt.

SUMMARY

An object of inventions of the present disclosure relates, in general, to woven textile fabric, and more specifically, relates to a means for fabricating multi-pieced woven quilts.

Another object of the present disclosure is to provide a textile fabric in which any pattern can be made.

Another object of the present disclosure is to provide a textile fabric that can be made with multi-colored designs and engineered patterns.

Another object of the present disclosure is to provide a textile fabric that enables safe and secured binding using warp and weft threads.

Another object of the present disclosure is to provide a textile fabric that reduces the number of operations.

Another object of the present disclosure is to provide a textile fabric that is cost-effective.

Another object of the present disclosure is to provide a textile fabric that provides uniform loft of the final product as it is made by weaving using strands of continuous filament.

Another object of the present disclosure reduces time, carbon footprint, labor, and power consumption.

Yet another object of the present disclosure is to provide a textile fabric that prevents the protrusion of filaments and loose fibers.

The present disclosure relates, in general, to woven textile fabric, and more specifically, relates to a means for fabricating multi-pieced woven quilts.

In one example, inventions of the present disclosure provides a textile fabric comprising a casing of three layers, the three layers comprising a top layer, a bottom layer, and an intermediate layer that is arranged between the top layer and bottom layer, wherein the top layer, the intermediate layer, and the bottom layers are bonded together through weaving.

According to an embodiment, the top layer and the bottom layer is made of a suitable blend of fibers.

According to an embodiment, the blend of fibers can be cotton or any combination thereof.

According to an embodiment, the intermediate layer is made of a combination of polyester fibers.

According to an embodiment, an intermediate layer may have a predetermined denier based on a weight requirement of the fabric, where the predetermined denier is texturized and an interwoven poly-filament is intersected between the top layer and the bottom layer.

According to an embodiment, the top layer, the intermediate layer, and the bottom layer are interlaced by warp and weft fabrics.

According to an embodiment, the warp and weft fabrics of the three layers are interlaced with one another according to the type of weave.

According to an embodiment, the three layers are bonded in position relative to one another in a manner in which the planar configuration exhibited by the three layers of fabrics is maintained.

According to an embodiment, the textile fabric can be a woven quilt or any combination thereof.

Various objects, features, aspects, and advantages of the inventive subject matter will become more apparent from the following detailed description of preferred embodiments, along with the accompanying drawing figures in which like numerals represent like components.

BRIEF DESCRIPTION OF THE DRAWINGS

The following drawings form part of the specification and are included to further illustrate aspects of the present disclosure. The disclosure may be better understood by reference to the drawings in combination with the detailed description of the specific embodiments presented herein.

DETAILED DESCRIPTION

The following is a detailed description of embodiments of the disclosure depicted in the accompanying drawings. The embodiments are in such detail as to clearly communicate the disclosure. If the specification states a component or feature "may," "can," "could," or "might" be included or have a characteristic, that particular component or feature is not required to be included or have the characteristic.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Reference throughout this specification to "an aspect," "another aspect" or similar language means that a particular feature, structure, or characteristic described in connection with the embodiment is included in at least one embodiment of the present disclosure. Thus, appearances of the phrase "in an embodiment," "in another embodiment," and similar language throughout this specification may, but do not necessarily, all refer to the same embodiment. The description and references provided in this section serves to understand the present disclosure and is not an admission of prior art unless explicitly stated. Unless otherwise defined, all technical and scientific terms used herein have the same meaning as commonly understood by one of ordinary skilled in the art to which this disclosure belongs. The structure, methods, and examples provided herein are illustrative only and not intended to be limiting.

Figure 1A:
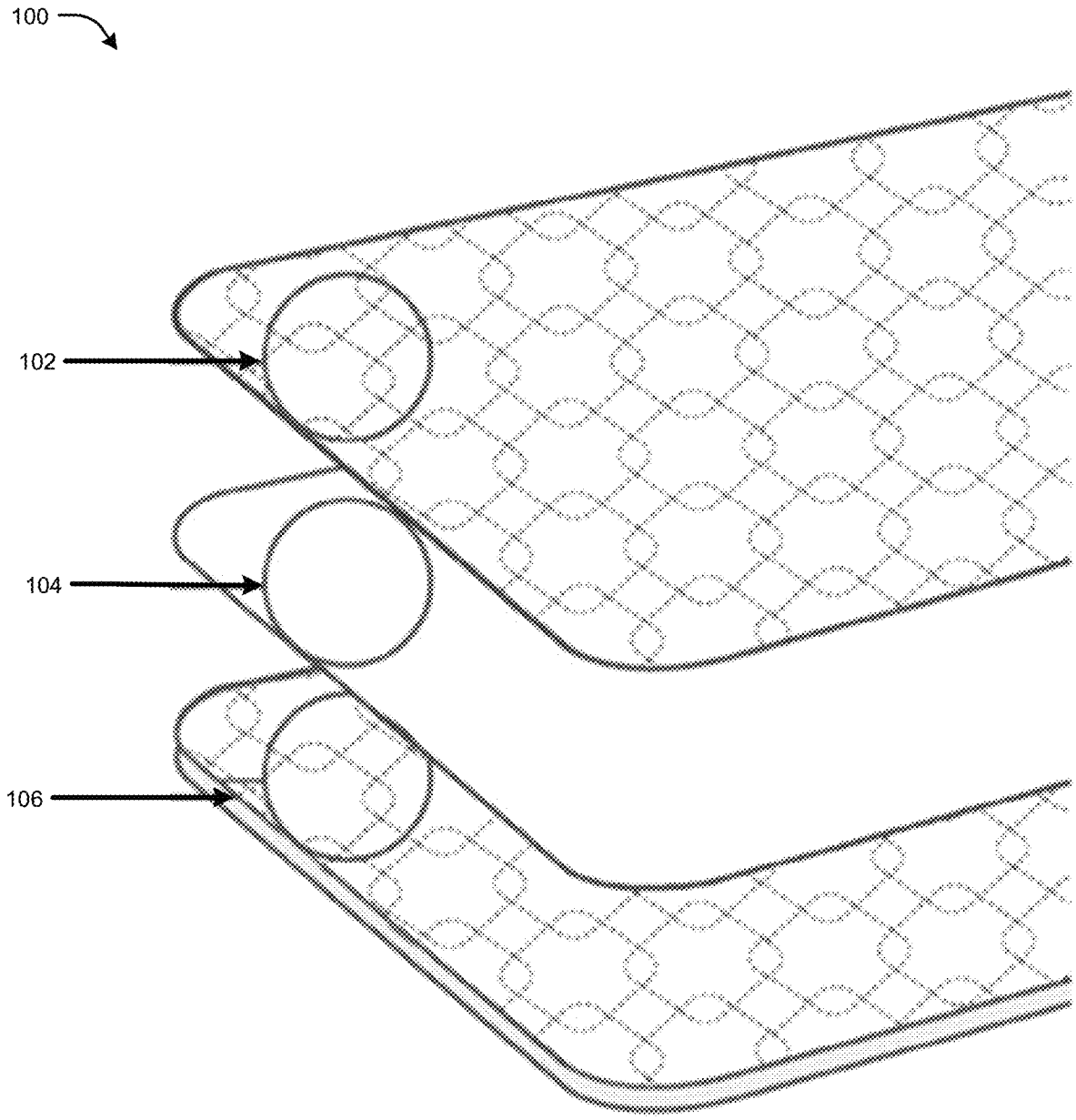
FIGS. 1A and 1B illustrate conventional process of quilting.
Figure 1C:
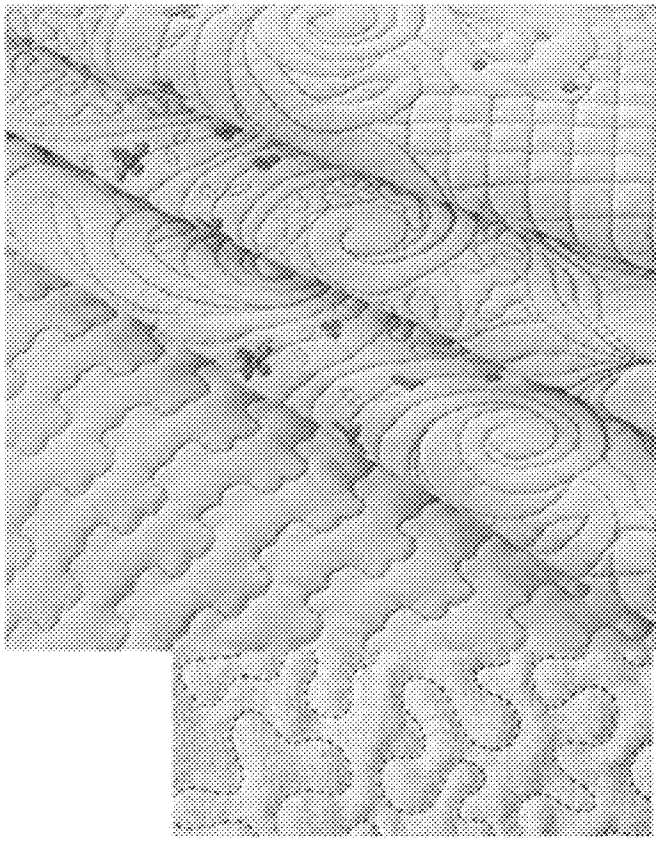
FIG. 1C illustrate textile product produced by conventional quilting.
Figure 1B:
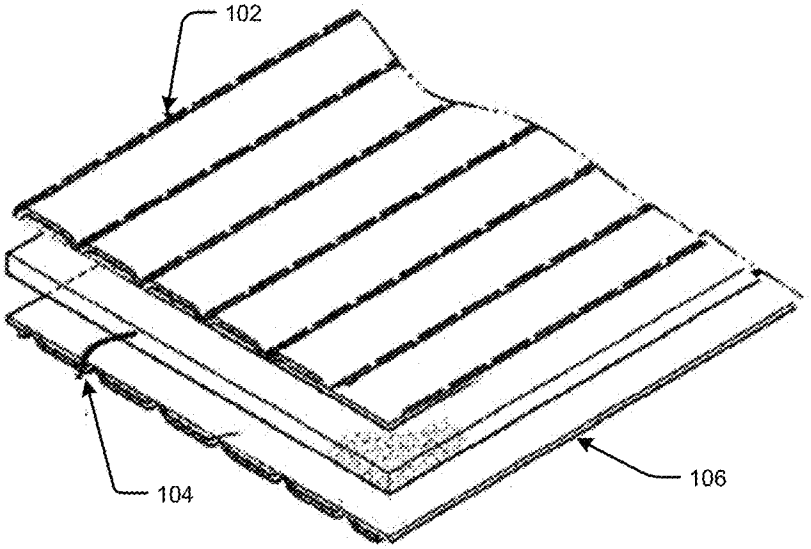

FIGS. 1A and 1B illustrate conventional process of quilting.

The fabric 100 can include three layers, where the three layers can include a top layer 102, middle layer 104 and a bottom layer 106. The top layer 102 and the bottom layer 106 can be made of cotton fabric and the middle layer 104 can be made of polyester wadding filler. The top layer 102, the middle layer 104 and the bottom layer 106 are shown in FIG. 1B are bonded together by sewing. The textile product 100 formed by sewing is shown FIG. 1C.

However, the conventional fabric bonded together by sewing suffers from significant drawbacks that include: 1) breaking of top stitches during washing resulting in the de-shaping of the textile product; 2) individual fibers may protrude through pores of fabric, causing discomfort to the user while sleeping; 3) increase in time and cost; 4) increase in power consumption; 5) increase in carbon footprint; and 6) increase in labor.

Inventions of the present disclosure relates, in general, to a woven textile fabric, and more specifically, to a system for fabricating multi-pieced woven quilts. The textile fabric of the present disclosure can include three layers and enable overcoming the limitations of the prior art by bonding the three layers through weaving.

The proposed woven quilt, incorporating a top fabric layer, suitable denier texturized and interwoven poly-filament weft as the intermediate layer, and a bottom fabric layer, where the top layer, the intermediate layer, and the bottom layer positioned one above the other are bonded together through weaving.

The term "denier" as used herein refers to the number of grams per 9000 m, using a direct yarn numbering system expressing yarn number in terms of mass per unit length.

The term "filament" as used herein refers to a variety of fiber having an extreme length which are not readily measured.

A technical advantage of inventions the present disclosure relates to enabling safe and secured stitches using warp and weft fabrics. The process of developing the woven quilt reduces the number of operations and reduces time, carbon footprint, labor, and power consumption. A uniform loft of the final fabric is provided as it is made by weaving using strands of continuous filament and prevents the protrusion of filaments and loose fibers. Certain examples may represent more than one embodiment as described in the present disclosure. One of skill in the art will understand the invention is not limited to the specific embodiments and examples detailed only and may realize additional embodiments and combinations of those specific ones described. Numerous modifications, changes, variations, substitutions, and equivalents of the embodiments are possible within the scope of the present disclosure. Additionally, the invention can include other embodiments that are within the scope of the claims but are not described in detail with respect to the following description.

Figure 2A:
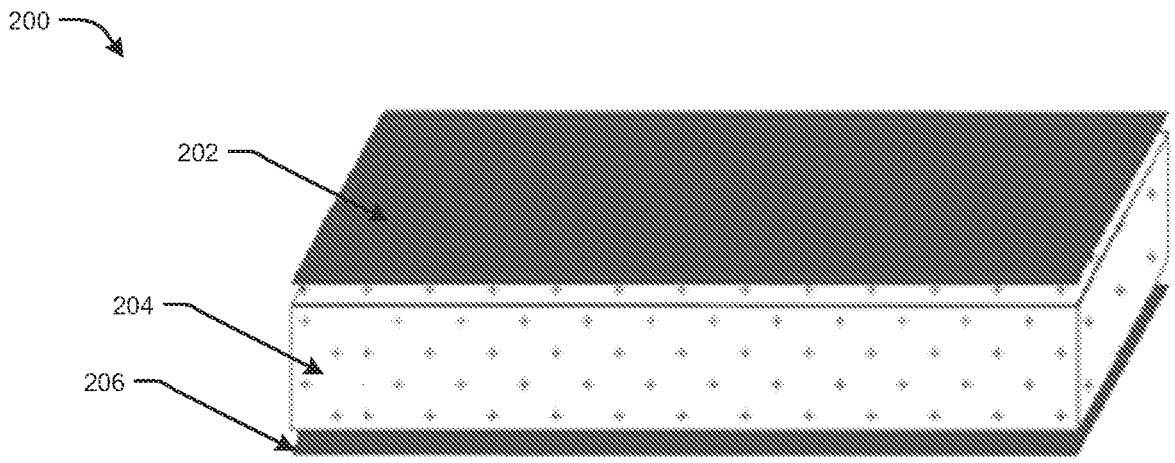
FIGS. 2A and 2B illustrate exemplary representation of three layers for quilting, in accordance with an embodiment of the present disclosure.
Figure 2B:
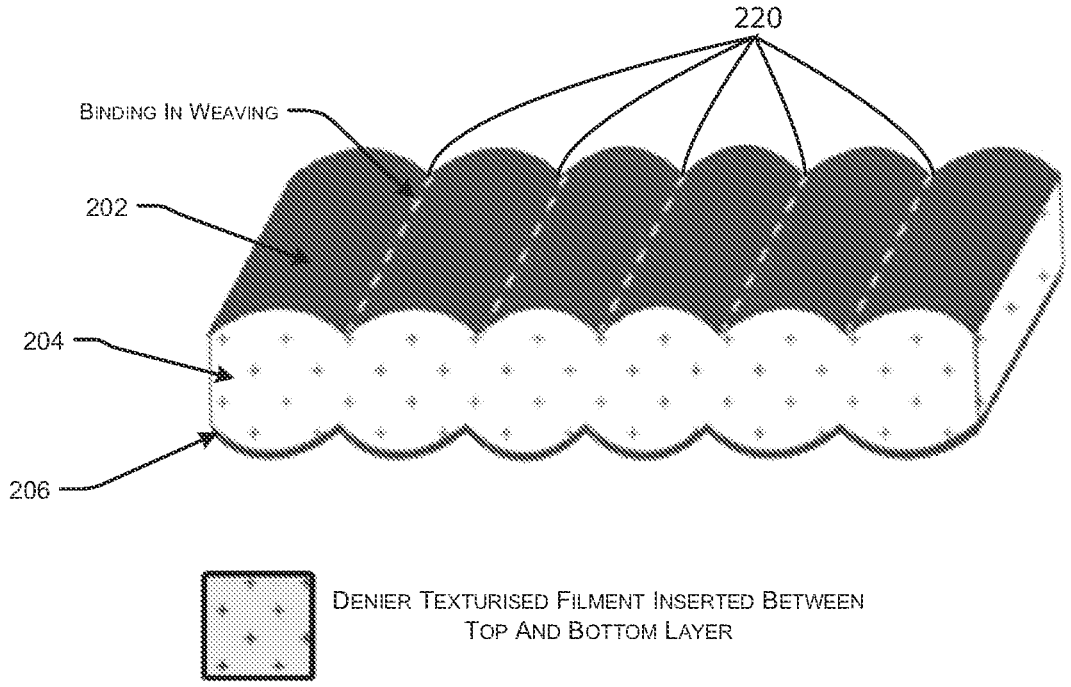

FIGS. 2A to 2B illustrate exemplary embodiments of a woven fabric. A woven fabric may include a set of three layers for quilting. A woven fabric may be a quilt in some examples.

Referring to FIG. 2A, a textile fabric 200 can include a casing made up of three layers of filaments/fibers. The three layers can include a top layer 202, an intermediate layer 204 and a bottom layer 206. The top layer 202, the intermediate layer 204, and the bottom layer 206 are bonded together through weaving and secure the layers together at intervals throughout the dimension. The top layer 202 and bottom layer 206 are positioned one above the other, preferably in direct mechanical contact and the intermediate layer 204 can be arranged between the top layer 202 and bottom layer 206.

In an exemplary embodiment, the textile fabric 200 may be a woven quilt. As can be appreciated, the inventions of the present disclosure may not be limited to this configuration but may be extended to other configurations that include a variety of textile products. The woven quilt 200 is generally rectangular, with a top layer, middle layer, and bottom layer. However, in some examples, the actual shape of the quilt is not necessarily rectangular in that it may be customized to possess any general shape and design.

The top layer 202 can include a decorative knit, woven or the like upon a fabric surface, that may be utilized as an upper surface when positioned on an object. The bottom layer 206 may be a decorative knit, woven, or the like, and a fabric surface utilized as the under surface when positioned on the object. The object can be a bed or any suitable object for a fabric covering. In an exemplary embodiment, the top layer 202 and the bottom layer 206 are made of a suitable blend of fibers, where the suitable blend of fibers may be cotton or a combination thereof.

The intermediate layer 204 can form a fabric surface utilized as a middle surface. In an exemplary embodiment, the intermediate layer 204 may have a predetermined denier based on the weight requirement of the fabric, where the predetermined denier includes a texturized and interwoven poly-filament intersected between the top layer 202 and the bottom layer 206. The predetermined denier can be, for example, 1320 denier or any suitable thread count based on the weight requirement of the fabrics. The intermediate layer 204 may be made of a combination of polyester fibers.

The woven quilt 200 is formed by interlacing the warp and the weft fabrics of the three layers (202, 204, 206). The interlacement of the top layer 202, the interlacement of the middle layer 204 and the interlacement of the bottom layer 206 are shown in FIG. 2B. The interlacement produces a woven quilt having much stronger binding element than those produced by a conventional sewing machine and, in addition, they cannot be unraveled as often happens with the conventional method. Hence, the finished woven quilt 200 is more robust and harder wearing than the conventionally sewn quilt.

A binding element 220 binds weft and warp fabrics of the three layers (202, 204, 206). The three layers (202, 204, 206) are held by the binding element, whose essential function is that of binding the layers. The binding element 220 secures the filaments/fabrics of the three layers (202, 204, 206) in position relative to one another in a manner in which the planar configuration exhibited by the three layers of filaments is maintained. A conventional quilting machine may be employed to quilt fabrics. The weaving machine can weave the top layer 202, the bottom layer 206, and the intermediate layer 206, by placing the intermediate layer 204 in the center.

Figure 2C:
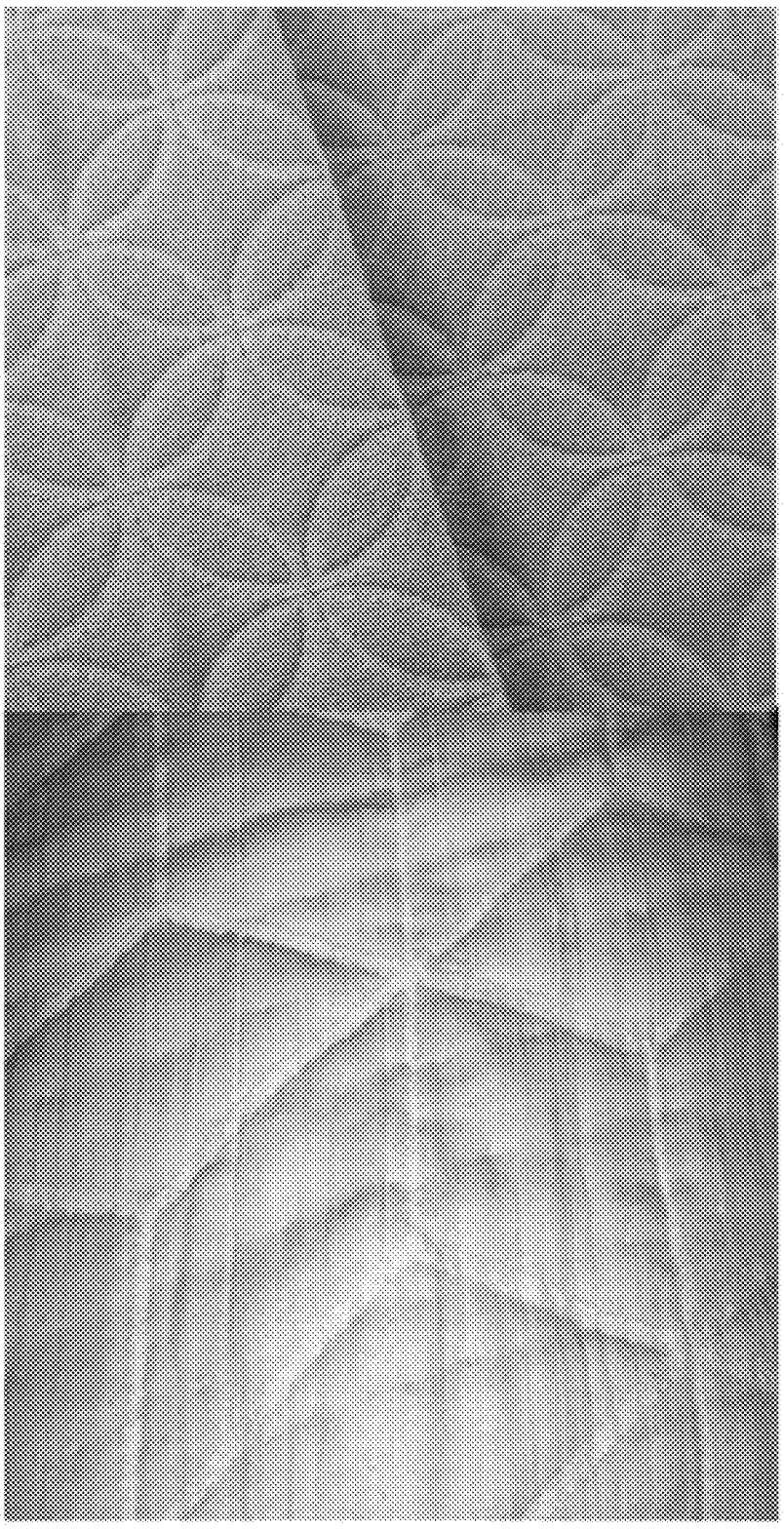
FIG. 2C illustrates an exemplary view of woven quilt, in accordance with an embodiment of the present disclosure.

The woven quilt 200 is shown in FIG. 2C is intended primarily to produce bedspreads, coats, mattresses, and the likes. It can be appreciated that clothing can also be manufactured from the textile fabric 200. The size of the quilt may correspond to all blankets of conventional mattress sizes, including, for example, king, queen, double, single and crib. However, size as well as shape may be changed or scaled up or down, accordingly.

The embodiments of the present disclosure described above provide several advantages. The one or more of the embodiments provide a woven quilt 200 in which any pattern can be made with multi-colored designs. Safe and secured binding element 220 as opposed to stitches can be enabled using the warp and weft fabrics. The process of developing the woven quilt reduces the number of operations, cost-effectiveness, reduces time, carbon footprint, labor, and power consumption. The uniform loft of the final product is provided as it is made by weaving using strands of continuous filament and prevents the protrusion of filaments and loose fibers since the binding element binds the weft and warp fabrics of the three layers.

The drawings and the forgoing description give examples of embodiments. Those skilled in the art will appreciate that one or more of the described elements may well be combined into a single functional element, exemplified by the binding element inserting along with the weaving process. Alternatively, certain elements may be split into multiple functional elements. Elements from one embodiment may be added to another embodiment. For example, orders of processes described herein may be changed and are not limited to the manner described herein.

It will be apparent to those skilled in the art that the woven quilt 200 of the disclosure may be provided using some or all of the mentioned features and components without departing from the scope of the present disclosure. While various embodiments of the present disclosure have been illustrated and described herein, it will be clear that the disclosure is not limited to these embodiments only. Numerous modifications, changes, variations, substitutions, and equivalents will be apparent to those skilled in the art, without departing from the scope of the disclosure, as described in the claims.

The inventions of the present disclosure provide a textile fabric in which any pattern can be made. Examples provide that a textile fabric can be made with multi-colored designs and engineered patterns. A textile fabric that enables safe and secured binding using warp and weft threads is disclosed. In some examples, a textile fabric may reduce-the number of operations, in a matter that is cost-effective.

Inventions of the present disclosure provide a textile fabric that provides uniform loft of the final product as it is made by weaving using strands of continuous filament. A textile fabric as disclosed, reduces production time, carbon footprint, labor, and power consumption. The inventions also include a textile fabric that prevents the protrusion of filaments and loose fibers.

I claim:

1. A woven textile fabric comprising:

a casing of three layers, the three layers comprising:

a top layer;

a bottom layer; and, an intermediate layer that is arranged between the top layer and the bottom layer, a binding element woven with the top layer, bottom layer, and intermediate layer, wherein the top layer, the intermediate layer, and the bottom layers are bonded together through weaving.

2. The textile fabric as claimed in claim 1, wherein the top layer and the bottom layer are made of a blend of fibers.

3. The textile fabric as claimed in claim 2, wherein the blend of fibers includes cotton.

4. The textile fabric as claimed in claim 3, wherein the intermediate layer is made of a combination of polyester fibers.

5. The textile fabric as claimed in claim 4, wherein the intermediate layer includes a predetermined denier that is based on a weight requirement of the fabric, and wherein the predetermined denier is texturized and is an interwoven poly-filament that is intersected between the top layer and the bottom layer during the weaving process.

6. The textile fabric as claimed in claim 1, wherein the top layer, the intermediate layer, and the bottom layer are interlaced by warp and weft fibers.

7. The textile fabric as claimed in claim 6, wherein the warp and weft fabrics of the three layers are interlaced with one another in a matter consistent with a type of weave utilized in producing a quilting design.

8. The textile fabric as claimed in claim 1, wherein the three layers are bonded in position relative to one another by way of the binding element in a manner in which the planar configuration exhibited by the three layers of fabrics is maintained.

9. The textile fabric as claimed in claim 1, wherein the textile fabric is a woven quilt.

10. The textile fabric as claimed in claim 1, including a continuous filament woven to achieve a uniform loft.

11. The textile fabric as claimed in claim 1, wherein the binding element is inserted into the casing on a quilting machine.

12. The textile fabric as claimed in claim 1, wherein the top layer, the intermediate layer, and intermediate layer and the bottom layer include yarns that are interlaced in either the warp or the weft by way of the binding element.

13. The textile fabric as claimed in claim 12 wherein the textile fabric layers are bonded to one another through a weaving bond.

14. A method for a woven textile fabric comprising:

forming a woven casing of three layers;

interlacing yarns of a top layer with an intermediate layer;

interlacing yarns of a bottom layer with said intermediate layer;

binding the three layers with a weaving element, wherein the binding element binds weft and/or warp fibers of the top layer, the intermediate layer, and the bottom layer.

15. The method for a woven textile fabric of claim 14 including creating a uniform loft formed by strands of continuous filament.

16. The method for a woven textile fabric of claim 15 including binding the woven textile fabric with the binding element to secure the three layers in position relative to one another such that a planar configuration of the three layers of fabrics is maintained.

17. The method for a woven textile fabric of claim 14 including inserting a binding element during the weaving process to bind the three layers one to another.

18. The method for a woven textile fabric of claim 14 including producing a woven textile by inserting a woven binder.

19. The method for a woven textile fabric of claim 14, wherein the woven textile is a woven quilt.

20. The method for a woven textile fabric of claim 14 including securing the layers together at intervals throughout the dimension of the woven textile fabric by way of interweaving a binding element.

* * * * *